US007686136B2

(12) United States Patent
Evans

(10) Patent No.: US 7,686,136 B2
(45) Date of Patent: Mar. 30, 2010

(54) AUTOMATED OIL-CHANGE SYSTEM AND METHOD

(76) Inventor: Larry Douglas Evans, 1030 C and E Dr., Tignall, GA (US) 30668

( * ) Notice: Subject to any disclaimer, the term of this patent is extended or adjusted under 35 U.S.C. 154(b) by 878 days.

(21) Appl. No.: 10/904,390

(22) Filed: Nov. 8, 2004

(65) Prior Publication Data

US 2006/0096809 A1 May 11, 2006

(51) Int. Cl.
*F16C 3/14* (2006.01)
*F16N 33/00* (2006.01)

(52) U.S. Cl. ..... 184/1.5; 184/6.5

(58) Field of Classification Search ..... 184/6.5, 184/15.3, 1.5; 123/196 R, 198 C; 440/88 R
See application file for complete search history.

(56) References Cited

U.S. PATENT DOCUMENTS 3,447,636 A * 6/1969 Bonfilio ..... 184/1.5
4,674,456 A * 6/1987 Merritt ..... 123/196 S
4,742,476 A * 5/1988 Schwartz et al. ..... 701/30
5,063,896 A * 11/1991 Hyatt et al. ..... 123/198 A
5,190,120 A * 3/1993 Watts ..... 184/1.5
5,372,219 A * 12/1994 Peralta ..... 184/1.5
5,390,762 A * 2/1995 Nelson ..... 184/1.5
5,460,656 A * 10/1995 Waelput et al. ..... 134/10
5,465,810 A * 11/1995 Peterson et al. ..... 184/6.21
5,562,181 A * 10/1996 Elkin et al. ..... 184/1.5
5,566,781 A * 10/1996 Robert et al. ..... 184/1.5
5,881,688 A * 3/1999 Graham et al. ..... 123/73 AD
6,164,346 A * 12/2000 Viken ..... 141/98
6,286,626 B1 9/2001 Evans
6,390,240 B1 * 5/2002 Schmidt et al. ..... 184/6.3
6,637,472 B2 * 10/2003 Camacho et al. ..... 141/98
6,923,190 B1 * 8/2005 Kavadeles et al. ..... 134/22.18
7,017,546 B1 * 3/2006 Patel et al. ..... 123/196 R
2001/0022203 A1 * 9/2001 Rome et al. ..... 141/98
2001/0047907 A1 * 12/2001 Viken ..... 184/1.5
2002/0003063 A1 * 1/2002 Ito et al. ..... 184/6.5
2002/0160671 A1 * 10/2002 Berthiaume et al. ..... 440/88
2003/0019690 A1 * 1/2003 Chandler ..... 184/1.5
2003/0089418 A1 * 5/2003 Few et al. ..... 141/65
2004/0020720 A1 * 2/2004 Flynn ..... 184/1.5
2004/0035640 A1 * 2/2004 Barnard et al. ..... 184/1.5
2004/0079589 A1 * 4/2004 Schneider ..... 184/1.5
2004/0134459 A1 * 7/2004 Korenjak et al. ..... 123/195 R
2004/0194847 A1 * 10/2004 Few ..... 141/65
2004/0211626 A1 * 10/2004 Waelput ..... 184/1.5
2004/0261748 A1 * 12/2004 Lafleur ..... 123/196 R
2005/0115769 A1 * 6/2005 Blount ..... 184/1.5
2005/0133304 A1 * 6/2005 Viken ..... 184/1.5

* cited by examiner

*Primary Examiner*—Robert A Siconolfi
*Assistant Examiner*—Thomas W Irvin
(74) *Attorney, Agent, or Firm*—Sutherland Asbill & Brennan LLP

(57) ABSTRACT

The present invention may provide an automatic oil-change system for an engine comprising: a first oil container, a second oil container and means for switching between the first oil container and the second oil container. The switching means may provide the engine with oil from the first oil container until a predetermined time and once a predetermined time is reached, the switching means may provide the engine with oil from the second oil container.

12 Claims, 1 Drawing Sheet

AUTOMATED OIL-CHANGE SYSTEM AND METHOD

TECHNICAL FIELD

The present invention relates to changing the motor oil in an engine. In particular, the present invention relates to automated systems and methods for changing the motor oil in an engine.

BACKGROUND OF THE INVENTION

Every 3000-5000 miles car owners should have the oil changed in their automobiles to prevent excessive engine wear. The current choices that car owners have for completing this necessary preventative maintenance generally include do-it-yourself alternatives or having the automobile serviced at a service center. Neither of these alternatives is either cost or time efficient, and generally lead to the oil being changed too infrequently.

Do-it-yourself alternatives generally have failed. Several patents, such as U.S. Pat. No. 5,372,219 to Peralta and U.S. Pat. No. 4,884,660 to Bedi, attempt to provide a method to speed up the oil change process. However, the adoption of these devices as well as the purchase of other specialized tools that aid in the oil changing process has been poor due to the complexity of the devices and tools and expense. Further, changing the oil "the old fashion way" generally requires the car owner to reach areas of the car that are hard to get to and come in contact with oily car parts. This makes the task difficult, dirty and time consuming to the car owner. As a result, many people who rely on such methods tend to put off the job, which, in many instances, causes the oil to be changed too infrequently. This leads to increased wear and tear to the engines of many vehicles.

Of course, car owners can have their car serviced at an auto-shop. In fact, "quick lubes" businesses are prevalent in many areas. However, this option is an expensive one to the car owner. Further, while these places profess to be "quick," long lines at the local quick-lube may force long waits. Also, the car owner must still get his car to the quick-lube (i.e., these businesses generally do not make house calls), which significantly increases the overall time spent getting the oil changed. The cost and inconvenience of going to an service center may cause car owners to put off changing the oil in their car. These people often wait until a "check engine" or "oil" dashboard light warns them that an oil change is needed immediately. Even then, though, an oil change is still a car ride way (i.e., either to the auto-parts store and home or to the local quick-lube) as the car owner has no way to change the oil in his car while driving. As a result, the car often ends up being driven past the time when its oil should have been changed. Again, this leads to increased wear and tear to the engines of many vehicles.

Therefore, there is a need for an automated oil changing device that is both cost-efficient and easy to use. Such a system should provide the car owner the option to change the oil whenever the optimum time for the change arises—evens if this means changing the oil while the vehicle is being driven.

SUMMARY OF THE INVENTION

Accordingly, the present invention may provide an automatic oil-change system for an engine as described herein. In certain embodiments, the automated oil change system of the present invention may include a first oil container, a second oil container, and means for switching between the first oil container and the second oil container. The switching means may provide the engine with oil from the first oil container until a predetermined time. Once the predetermined time is reached, the switching means may provide the engine with oil from the second oil container. The switching means may include multiple valves. The resetting of the settings of the multiple valves may cause the engine to use oil from the second oil container once the predetermined time is reached.

The multiple valves may include a three-way oil pump valve that connects the first oil container and the second oil container to an oil pump. The three-way oil pump valve may control the flow of oil from the first oil container and the second oil container to the oil pump. The multiple valves may further comprise a three-way return valve that connects a bottom fitting in the oil pan to the first oil container and the second oil container. The three-way return valve may control the flow of oil from the oil pan to the first oil container and the second oil container. The multiple valves may further comprise a three-way vacuum valve that connects the first oil container and the second oil container to a vacuum system of the engine. The three-way vacuum valve may control the flow of gas from the first oil container and the second oil container to the vacuum system of the engine. The automatic oil-change system may further comprise a vacuum regulator downstream of the three-way vacuum valve. The vacuum regulator may regulate the vacuum within the first oil container or the second oil container.

In certain embodiments, the three-way oil pump valve, before reaching the predetermined time, may be set to allow the flow of oil from the first oil container to the oil pump and prevent the flow of oil from the second oil container to the oil pump. The three-way return valve, before reaching the predetermined time, may be set to allow the flow of oil from the oil pan to the first oil container and prevent the flow of oil from the oil pan to the second oil container. The three-way vacuum valve, before reaching the predetermined time, may be set to allow the flow of gas from the first oil container to the vacuum system of the engine and prevent the flow of gas from the second oil container to the vacuum system of the engine. Once the predetermined time is reached, the three-way oil pump valve may be reset to allow the flow of oil from the second oil container to the oil pump and prevent the flow of oil from the first oil container to the oil pump, the three-way return valve may be reset to allow the flow of oil from the oil pan to the second oil container and prevent the flow of oil from the oil pan to the first oil container, and the three-way vacuum valve may be reset to allow the flow of gas from the second oil container to the vacuum system of the engine and prevent the flow of gas from the first oil container to the vacuum system of the engine.

In certain other embodiments, the three-way oil pump valve, the three-way return valve, and the three-way vacuum valve, upon reaching the predetermined time, may be reset in a staggered manner so to minimize the mixture of oil from first oil container and oil from the second oil container that occurs during the oil change. In certain of these embodiments, the setting of the three-way oil pump valve, before reaching the predetermined time, may allow the flow of oil from the first oil container to the oil pump and may prevent the flow of oil from the second oil container to the oil pump. The setting of the three-way return valve, before reaching the predetermined time, may allow the flow of oil from the oil pan to the first oil container and may prevent the flow of oil from the oil pan to the second oil container, before reaching the predetermined time. The setting of the three-way vacuum valve, before reaching the predetermined time, may allow the flow of gas from the first oil container to the vacuum system of the engine and may prevent the flow of gas from the second oil container to the vacuum system of the engine. Once the predetermined time is reached, the setting of the three-way oil pump valve may be reset to allow the flow of oil from the second oil container to the oil pump and prevent the flow of oil from the first oil container to the oil pump. During a stagger delay period that occurs after the predetermined time is reached, the settings of the three-way return valve and the three-way vacuum valve may remain the same. Once the stagger delay period has expired, the setting of the three-way return valve may be reset to allow the flow of oil from the oil pan to the second oil container and prevent the flow of oil from the oil pan to the first oil container and the setting of the three-way vacuum valve may be reset to allow the flow of gas from the second oil container to the vacuum system of the engine and prevent the flow of gas from the first oil container to the vacuum system of the engine.

In certain embodiments, the predetermined time may include a programmed milestone associated with the amount of use of the engine. In other embodiments, the predetermined time may include an operator chosen time.

In still other embodiments, the present invention may include a method for changing the oil automatically in an engine having a first oil container and a second oil container in communication therewith, which comprises the steps of: (1) using the oil from the first oil container in the engine until a predetermined time; and (2) using the oil from the second oil container once the predetermined time is reached. The engine may further include multiple valves, and the method may further include the step of resetting of the settings of the multiple valves to cause the engine to use oil from the second oil container once the predetermined time is reached.

In certain embodiments, the multiple valves may include a three-way oil pump valve that connects the first oil container and the second oil container to an oil pump. The method may further include the step of controlling the flow of oil from the first oil container and the second oil container to the oil pump with the three-way oil pump valve. The multiple valves may further include a three-way return valve that connects a bottom fitting in the oil pan to the first oil container and the second oil container. The method may further include the step of controlling the flow of oil from the oil pan to the first oil container and the second oil container with the three-way return valve. The multiple valves may further include a three-way vacuum valve that connects the first oil container and the second oil container to a vacuum system of the engine. The method may further include the step of controlling the flow of gas from the first oil container and the second oil container to the vacuum system of the engine with the three-way vacuum valve. The multiple valves may further include a vacuum regulator downstream of the three-way vacuum valve. The method may further include the step of regulating the vacuum within the first oil container or the second oil container with the vacuum valve.

Before reaching the predetermined time, the three-way oil pump valve, in certain other embodiments, may be set to allow the flow of oil from the first oil container to the oil pump and prevent the flow of oil from the second oil container to the oil pump. The three-way return valve may be set to allow the flow of oil from the oil pan to the first oil container and prevent the flow of oil from the oil pan to the second oil container. The three-way vacuum valve may be set to allow the flow of gas from the first oil container to the vacuum system of the engine and prevent the flow of gas from the second oil container to the vacuum system of the engine. The method may further comprise the steps of: (1) resetting the three-oil pump valve once the predetermined time is reached to allow the flow of oil from the second oil container to the oil pump and prevent the flow of oil from the first oil container to the oil pump; (2) resetting the three-way return valve once the predetermined time is reached to allow the flow of oil from the oil pan to the second oil container and prevent the flow of oil from the oil pan to the first oil container; and (3) resetting the three-way vacuum valve once the predetermined time is reached to allow the flow of gas from the second oil container to the vacuum system of the engine and prevent the flow of gas from the first oil container to the vacuum system of the engine.

In certain other embodiments, the method may further comprise the step of the resetting of the settings of the three-way oil pump valve, the three-way return valve, and the three-way vacuum valve, once the predetermined time is reached, in a staggered manner so to minimize the mixture of oil from first oil container and oil from the second oil container that occurs during the oil change. In certain of these embodiments, the setting of the three-way oil pump valve, before reaching the predetermined time, may allow the flow of oil from the first oil container to the oil pump and may prevent the flow of oil from the second oil container to the oil pump. The setting of the three-way return valve, before reaching the predetermined time, may allow the flow of oil from the oil pan to the first oil container and may prevent the flow of oil from the oil pan to the second oil container. The setting of the three-way vacuum valve, before reaching the predetermined time, may allow the flow of gas from the first oil container to the vacuum system of the engine and may prevent the flow of gas from the second oil container to the vacuum system of the engine. The method may further comprise the steps of: (1) resetting the setting of the three-way oil pump valve once the predetermined time is reached to allow the flow of oil from the second oil container to the oil pump and prevent the flow of oil from the first oil container to the oil pump; (2) during a stagger delay period that occurs after the predetermined time is reached, maintaining the same settings of the three-way return valve and the three-way vacuum valve; and (3) once the stagger delay period has expired, resetting the setting of the three-way return valve to allow the flow of oil from the oil pan to the second oil container and prevent the flow of oil from the oil pan to the first oil container and resetting the setting of the three-way vacuum valve to allow the flow of gas from the second oil container to the vacuum system of the engine and prevent the flow of gas from the first oil container to the vacuum system of the engine.

DETAILED DESCRIPTION OF EXEMPLARY EMBODIMENTS

Figure 1:
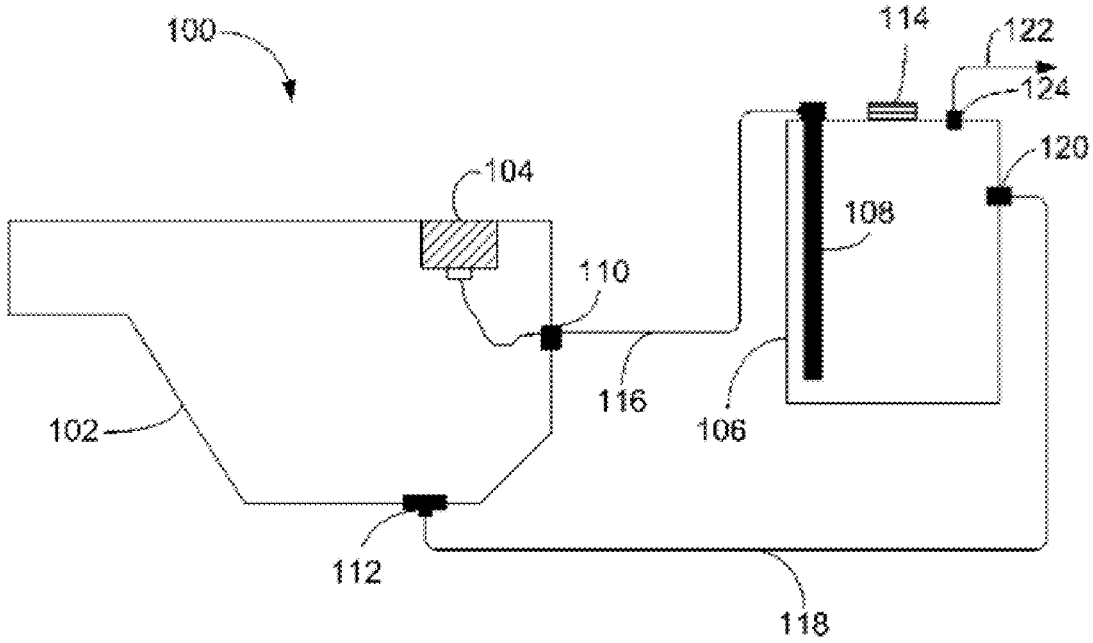
FIG. 1 is a section view of a schematic plan of an Automated Oil-Change System according to an embodiment of the present invention.

Referring now to the figure, where the various numbers represent like parts throughout the several views, FIG. 1 shows an exemplary embodiment of the present invention, an Automated Oil-Change System. The System, generally referred to by reference number 100, may include an oil pan 102, an oil pump 104, an oil container 106, and an oil strainer 108. It will be clear to those skilled in the art that the present invention could be used for replacing any type of engine fluid and be used in any type of engine.

Various connections may be made between the major components of System 100. The oil pan 102 may include an oil pan commonly known in the art that is modified as described below. The oil pan 102 may be located in the preferred location for the engine type. The oil pump 104 may be connected to the inner side of the top wall of the oil pan 102 by methods commonly known in the art. The oil pump 104 may include any of those commonly known in the art, including those commonly used in auto, lawn mower, tractor, or other applications. A bulk head fitting 110 may provide a sealed pass through fitting in one of the side walls of oil pan 102. The bulk head fitting 110 may be any of those commonly known in the art, including those used in hydraulic or other applications. A bottom fitting 112 may be provided in the bottom of the oil pan 102 to give access through the bottom of the oil pan 102. The bottom fitting 112 may be one of those commonly known in the art, including those fittings used in auto applications to connect the rubber brake hose to the brake caliper.

The oil strainer 108 may be attached to the top of the oil container 106 so that the oil strainer 108 extends down into the oil container 106. The oil strainer 108 may be one of those commonly known in the art, including fine wire mesh strainers or other types. The oil container 106 may be formed in any shape capable of holding oil. The oil container 106 may include an externally threaded opening 114 such that an internally threaded lid may be used to gain access to the oil container 106 to fill and remove oil as needed. The oil container 106 may be close to the engine, such as in the engine compartment, or in other parts of the automobile, such as the trunk. The oil container 106 may be secured in its location by adhesive, bolt, or any other method known in the art. The oil container 106 may also be mounted with a removable strap such that the oil container 106 may be removed with little effort. Though not shown because of the nature of the section view of FIG. 1, System 100 includes two or more oil containers 106, as demonstrated in FIG. 2.

The oil pump 104 may connect to the oil strainer 108 via the bulkhead fitting 110 by means of a first tube 116. The first tube 116 may be flexible or rigid and may be one of those commonly known in the art, including a braided wire hose, a rigid metal tube, hydraulic tubing, or brake tubing. Depending on the location of the oil container 106, the first tube 116 may be mounted to the chassis for support. The first tube 116 may allow for the communication of fluid between the oil pump 104 and the oil container 106 via the oil strainer 108.

A second tube 118 may connect the oil container 106 to the bottom fitting 112. The second tube 118 may be flexible or rigid and may be one of those commonly known in the art, including a braided wire hose, a rigid metal tube, hydraulic tubing, or brake tubing. The second tube 118 also may be mounted to the chassis, depending on the location of the oil container 106. The second tube 118 may communicate with the oil container 106 through a container fitting 120. The second tube 118 may allow for the communication of fluid between the oil container 106 and the oil pan 102 via connections made at the container fitting 120 and the bottom fitting 112. The container fitting 120 may be one of those commonly known in the art, including those used in hydraulic of brake applications or any fitting comprising a flare seat, and may form a tight seal with the second tube 118. The bottom fitting 112 may be one of those commonly known in the art, including those used in hydraulic or brake applications or any fitting comprising a flare seat, and may form a tight seal with the second tube 118.

System 100 may further include a vacuum line 122. The vacuum line 122 may include a tube that may be rigid or flexible and may be one of those commonly known in the art, including a rubber vacuum hose or other similar hose. The vacuum line 122 may communicate with the oil container 106 through a vacuum fitting 124. The vacuum line 122 may connect with the vacuum system of the engine. The vacuum line 122 may allow for the communication of gas between the oil container 106 and the vacuum system via the connection made at the vacuum fitting 124. The vacuum fitting 124 may be one of those commonly known in the art, including a fitting used in brake or hydraulic applications, and may form a tight seal with the vacuum line 122.

Figure 2:
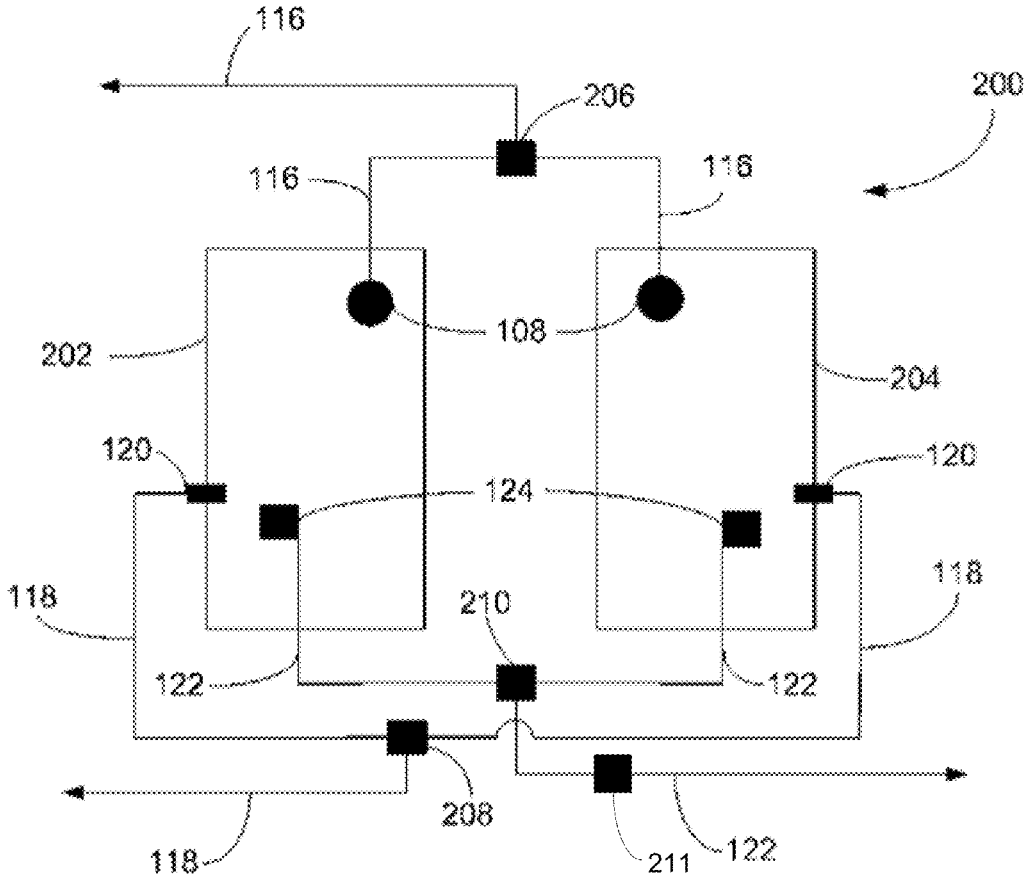
FIG. 2 is an overhead view of a schematic plan of the oil container assembly for an Automated Oil-Change System according to certain embodiments of the present invention.

FIG. 2 is an overhead view of a schematic plan of an oil container assembly 200 according to certain embodiments of System 100. As stated, System 100 may include two or more oil containers 106. Oil container assembly 200, as shown in FIG. 2, includes two oil containers, which include a left oil container 202 and a right oil container 204. Each of the oil containers 202, 204 may include the oil strainer 108, the container fitting 120, and the vacuum fitting 124. Each of the oil containers 202, 204 may communicate with the first tube 116 via the oil strainer 108. The first tube 116 from each of the two oil containers 202, 204 may combine at a three-way oil pump valve 206. From the three-way oil pump valve 206, the first tube 116 may then continue to its connection with the oil pump 104. The three-way oil pump valve 206 may control the flow of oil from the left oil container 202 and the right oil container 204 to the oil pump 104. The three-way oil pump valve 206 may include any manual or electronically controlled three-way valve commonly known in the art, including those used in hydraulic applications or other applications where there is a need to start/stop fluid flow instantly.

Each of the oil containers 202, 204 may connect to the second tube 118 via the container fitting 120. The second tube 118 from each of the two oil containers 202, 204 may combine at a three-way return valve 208. The second tube 118 may then continue from the three-way return valve 208 to its connection with the bottom fitting 112. The three-way return valve 208 may control the flow of oil from the bottom fitting 112 of the oil pan 102 to the left oil container 202 and the right oil container 204. The three-way return valve 208 may include any manual or electronically controlled three-way valve commonly known in the art, including those used in hydraulic applications or other applications where there is a need to start/stop fluid flow instantly.

Each of the oil containers 202, 204 may connect to the vacuum line 122 via the vacuum fitting 124. The vacuum line 122 from each of the two oil containers 202, 204 may combine at a three-way vacuum valve 210. The vacuum line 122 may then continue from the three-way vacuum valve 210 to its connection with the vacuum system in the car engine. The three-way vacuum valve may control the flow of gas from the left oil container 202 and the right oil container 204 to the vacuum system of the engine. The three-way vacuum valve 206 may include any manual or electronically controlled three-way valve commonly known in the art, including those used in hydraulic applications or other applications where there is a need to start/stop fluid or gas flow instantly.

Those of ordinary skill in the art will appreciate that if additional oil containers 106 are used in the system (i.e., more than two), the number of inputs to the three-way values described above may be increased to accommodate the additional oil containers 106. Thus, if three oil containers 106 are used in the system, a four-way valve may be necessary. Further, those of ordinary skill in the art will appreciate that the function of the several three-way valves 206, 208, 210 (or valves with a greater number of inputs) may be achieved in numerous ways through the use of different connectors (T-connectors and the like) and different valve configurations without deviating from the inventive concept described herein. As stated, the system 100 may include either electronically or manually controlled three-way valves 206, 208, 210. For the purposes of the description of the system in use, the three-way valves 206, 208, 210 are described to be electronically controlled. Those of ordinary skill will appreciate that in the case where the three-way valves 206, 208, 210 are manually controlled, the extra step of manually setting the three-way valves 206, 208, 210 to the appropriate setting would be required.

In use, System 100 may allow the automatic changing of the oil in the car at any time with little or no operator input required. For example, the electronically controlled three-way valves 206, 208, 210 initially may be set such that the engine is using the oil from the left oil container 202. This may be accomplished by setting the three-way oil pump valve 206 to allow oil flow only from the left oil container 202 (thus preventing any oil flow from the right oil container 204), setting the three-way return valve 208 to allow flow from the oil pan 102 to only the left oil container 202 (thus preventing any oil flow to the right oil container 204), and setting the three-way vacuum valve 210 to allow air flow to the vacuum system of the engine from only the left oil container 202 (thus preventing any air flow to the vacuum system of the engine from the right oil container 204).

With the above-described settings of the three-way valves 206, 208, 210, the oil pump 104 draws oil from the left oil container 202 via the first tube 116. The vacuum created in the left oil container 202 by the oil pump 104 draws oil from the lower parts of the oil pan 102 into the second tube 118 and back to the left oil container 202 for re-use. The vacuum line 122 may further create a vacuum in the left oil container 202 and, as such, may be used to maintain a constant vacuum level in the left oil container 202. This may be accomplished with a vacuum regulator 211. The vacuum regulator 211, which may be located downstream of the three-way vacuum valve 210, may be a release valve that maintains the vacuum within the left oil container 202 at a substantially constant level and insures that a maximum limit is not exceeded. The vacuum regulator 211 may be an electronically controlled release valve or a mechanical release valve.

The settings of the three-way valves 206, 208, 210 may be controlled by a computerized controller (not shown). The controller may be programmed to initiate an oil-change to correspond to certain engine usage milestones, i.e., a period of time (e.g., 3 months) or a distance (e.g., 3000 miles). The controller may instead be set to initiate an oil-change at operator command or whatever may be optimal for the particular engine type. When whatever applicable conditions are satisfied, the controller may initiate an oil-change by re-setting the electronically controlled three-way valves 206, 208, 210 such that the right oil container 204 (and its non-used oil) is brought on-line and the left oil container 202 (and its used oil) is isolated. This may be accomplished by setting the three-way oil pump valve 206 to allow oil flow only from the right oil container 204 (thus preventing any oil flow from the left oil container 202), setting the three-way return valve 208 to allow flow from the oil pan 102 to only the right oil container 204 (thus preventing any oil flow to the left oil container 202), and setting the three-way vacuum valve 210 to allow air flow to the vacuum system of the engine from only the right oil container 204 (thus preventing any air flow to the vacuum system of the engine from the left oil container 202).

In certain embodiments, the opening/closing of the valves during an oil-change may be further controlled to prevent less mixture between the used oil and the non-used oil. This may be accomplished by staggering the changing of the settings of the three-way valves 206, 208, 210 in a certain manner. For example, in making the change from the left oil container 202 to the right oil container 204, the three-way oil pump valve 206 may be first reset to allow oil flow only from the right oil container 204, while the other three-way valves 208, 210 remain unchanged. The System 100, in this setting, begins drawing non-used oil from the right oil container 204 while still pumping the used oil that is currently in the engine into the left oil container 202 (because, as stated, the three-way return valve 208 and the three-way vacuum valve 210 remain as previously set). After a predetermined delay has occurred (in which an appropriate amount of used oil has been returned to the left oil container 202 to minimize the amount of mixture between used and non-used oil), the three-way return valve 208 may be set to allow flow from the bottom fitting 112 of the oil pan 102 to only the right oil container 204 and the three-way vacuum valve 210 may be set to allow gas flow to the vacuum system of the engine from only the right oil container 204. At this point, oil will be drawn and returned from the engine to the right oil container 204. In this way, the oil change may be completed with a minimum of mixture of non-used and used oil.

Therefore, the functioning described herein may allow an oil-change to be completed automatically at any time the engine is being operated, even, for example in the case of an automobile, while the automobile is being driven, i.e., is in motion. Further, it allows the oil change to be programmed to occur at particular times. Thus, whenever the optimum time for an oil change is reached, the oil change may be completed. Once completed, the car owner may then remove the used oil in the left oil container 202 and replace it with a fresh supply. When the next oil change is required, the new supply thus will be ready. The next oil change may occur in the same manner, except the settings of the three-way valves 206, 208, 210 will be re-set to bring the supply of fresh oil in the left oil container 202 on-line (and isolate the supply of now used oil in the right oil container 204).

It will be apparent to those skilled in the art that many changes and substitutions can be made to the embodiments described herein without departing from the spirit and scope of the present invention and the equivalents thereof.

What is claimed is:

1. An automatic oil-change system for an engine comprising:

a first oil container;

a second oil container;

one or more valves associated with the first oil container and the second oil container, the one or more valves comprising:

a three-way oil pump valve that connects the first oil container and the second oil container to an oil pump, the three-way oil pump valve controlling oil flow from the first oil container and the second oil container to the oil pump;

a three-way return valve that connects a bottom fitting in an oil pan to the first oil container and the second oil container, the three-way return valve controlling oil flow from the oil pan to the first oil container and the second oil container; and a three-way vacuum valve that connects the first oil container and the second oil container to a vacuum system of the engine, the three-way vacuum valve controlling air flow from the first oil container and the second oil container to the vacuum system of the engine; and a vacuum regulator located between the three-way vacuum valve and the vacuum system of the engine, wherein the vacuum regulator regulates the vacuum within the first oil container and the second oil container to ensure that a maximum limit is not exceeded;

wherein the engine is provided with oil from the first oil container when the valves are in a first configuration; and wherein the engine is provided with oil from the second oil container when the valves are in a second configuration; and a controller operable to switch the valves from the first configuration to the second configuration in response to the valves remaining in the first configuration for a predefined distance, as measured over multiple initializations of the engine.

2. The automatic oil-change system of claim 1, wherein when the valves are in the first configuration, the three-way oil pump valve is set to allow the flow of oil from the first oil container to the oil pump and to prevent the flow of oil from the second oil container to the oil pump, the three-way return valve is set to allow the flow of oil from the oil pan to the first oil container and to prevent the flow of oil from the oil pan to the second oil container, and the three-way vacuum valve is set to allow the flow of air from the first oil container to the vacuum system of the engine and to prevent the flow of air from the second oil container to the vacuum system of the engine; and wherein when the valves are in the second configuration, the three-way oil pump valve is reset to allow the flow of oil from the second oil container to the oil pump and to prevent the flow of oil from the first oil container to the oil pump, the three-way return valve is reset to allow the flow of oil from the oil pan to the second oil container and to prevent the flow of oil from the oil pan to the first oil container, and the three-way vacuum valve is reset to allow the flow of air from the second oil container to the vacuum system of the engine and prevent the flow of air from the first oil container to the vacuum system of the engine.

3. The automatic oil-change system of claim 1, wherein the controller is operable to reset the three-way oil pump valve, the three-way return valve, and the three-way vacuum valve in a staggered manner so to reduce the mixing of oil from first oil container with oil from the second oil container as the valves are switched from the first configuration to the second configuration.

4. The automatic oil-change system of claim 2, wherein the controller is further operable to switch the valves from the first configuration to the second configuration by switching the valves from the first configuration to an interim configuration, temporarily maintaining the valves in the interim configuration, and switching the valves from the interim configuration to the second configuration;

wherein when the valves are in the interim configuration, the three-way oil pump valve allows the flow of oil from the second oil container to the oil pump and prevents the flow of oil from the first oil container to the oil pump, the three-way return valve allows the flow of oil from the oil pan to the first oil container and prevents the flow of oil from the oil pan to the second oil container, and the three-way vacuum valve allows the flow of air from the first oil container to the vacuum system of the engine and prevents the flow of air from the second oil container to the vacuum system of the engine.

5. The automatic oil-change system of claim 1, wherein the controller is further operable to permit an operator to switch the valves from the first configuration to the second configuration.

6. The automatic oil-change system of claim 1, wherein the engine powers an automobile and the controller is operable to switch the valves from the first configuration to the second configuration while the automobile is running.

7. A method for automatically changing oil in an engine of a vehicle, the engine including multiple valves, the method comprising:

monitoring usage data, the usage data being an accumulated distance that the vehicle has traveled with the engine using oil from the first oil container, as measured over multiple initializations of the engine; and controlling a flow of oil in the engine, based at least in part on the accumulated usage data, the engine using the oil from the first oil container until the accumulated usage data reaches a predetermined limit and the engine using oil from a second oil container after the predetermined limit is reached;

wherein the multiple valves include a three-way oil pump valve that connects the first oil container and the second oil container to an oil pump, a three-way return valve that connects a bottom fitting in an oil pan to the first oil container and the second oil container, a three-way vacuum valve that connects the first oil container and the second oil container to a vacuum system of the engine, and a vacuum regulator located between the three-way vacuum valve and the vacuum system of the engine; and wherein controlling a flow of oil in the engine comprises:

controlling oil flow from the first oil container and the second oil container to the oil pump with the three-way oil pump valve, and from the oil pan to the first oil container and the second oil container with the three-way return valve, controlling air flow from the first oil container and the second oil container to the vacuum system of the engine with the three-way vacuum valve, regulating the vacuum within the first oil container and the second oil container with the vacuum regulator to ensure that a maximum limit is not exceeded; and resetting the multiple valves to cause the engine to use oil from the second oil container after the predetermined limit is reached.

8. The method of claim 7, wherein controlling a flow of oil in the engine comprises:

setting the multiple valves in a first configuration until the usage data reaches the predetermined limit, wherein when the multiples valves are in the first configuration the three-way oil pump valve is set to allow the flow of oil from the first oil container to the oil pump and to prevent the flow of oil from the second oil container to the oil pump, the three-way return valve is set to allow the flow of oil from the oil pan to the first oil container and to prevent the flow of oil from the oil pan to the second oil container, and the three-way vacuum valve is set to allow the flow of air from the first oil container to the vacuum system of the engine and to prevent the flow of air from the second oil container to the vacuum system of the engine; and setting the multiple valves in a second configuration after the usage data reaches the predetermined limit, wherein when the multiples valves are in the second configuration the three-oil pump valve is set to allow the flow of oil from the second oil container to the oil pump and to prevent the flow of oil from the first oil container to the oil pump, the three-way return valve is set to allow the flow of oil from the oil pan to the second oil container and to prevent the flow of oil from the oil pan to the first oil container, and the three-way vacuum valve is set to allow the flow of air from the second oil container to the vacuum system of the engine and to prevent the flow of air from the first oil container to the vacuum system of the engine.

9. The method of claim 7, further comprising setting the multiple valves in an interim configuration once the usage data reaches the predetermined limit so to reduce mixing of oil from first oil container and oil from the second oil container during the oil change.

10. The method of claim 8, wherein setting the multiple valves in a second configuration further comprises resetting the three-way oil pump valve to allow the flow of oil from the second oil container to the oil pump and to prevent the flow of oil from the first oil container to the oil pump before resetting of the three-way return valve to allow the flow of oil from the oil pan to the second oil container and to prevent the flow of oil from the oil pan to the first oil container and before resetting of the three-way vacuum valve to allow the flow of air from the second oil container to the vacuum system of the engine and to prevent the flow of air from the first oil container to the vacuum system of the engine.

11. The method of claim 7, wherein controlling a flow of oil in the engine based at least in part on the usage data further comprises controlling the flow of oil in the engine based at least in part on an input from an operator.

12. The method of claim 7, wherein the predetermined limit is reached while the vehicle is running.

* * * * *